United States Patent [19]

Henrich

[11] Patent Number: 4,907,567

[45] Date of Patent: Mar. 13, 1990

[54] ADJUSTABLE MULTI FUNCTION ROTARY BOW STABILIZER

[76] Inventor: Richard L. Henrich, 407 N. Harrison, Emmetsburg, Iowa 50536

[21] Appl. No.: 193,504

[22] Filed: May 12, 1988

[51] Int. Cl.[4] ..... F41B 5/00

[52] U.S. Cl. ..... 124/89; 124/86; 124/23 R

[58] Field of Search ..... 124/89, 86, 80, 23 R; 273/416, 419, 421, 422; 81/489, 490, 491, 492; 224/916; 206/572, 579, 230, 234, 3, 315.11, 315.1

[56] References Cited

U.S. PATENT DOCUMENTS

| | | | |
|---|---|---|---|
| 19,901 | 4/1858 | Aiken | 81/490 |
| 2,684,852 | 7/1954 | Romeka . | |
| 3,196,860 | 7/1965 | Hoyt, Jr. . | |
| 3,342,172 | 9/1967 | Sanders . | |
| 3,412,725 | 11/1968 | Hoyt, Jr. . | |
| 3,468,297 | 9/1969 | Cress . | |
| 3,502,062 | 3/1970 | Shurts . | |
| 3,524,441 | 8/1970 | Jeffery . | |
| 3,570,608 | 3/1971 | Masterfield . | |
| 3,589,350 | 6/1971 | Hoyt, Jr. . | |
| 3,628,520 | 12/1971 | Izuta . | |
| 3,752,142 | 8/1973 | Morita et al. . | |
| 3,804,072 | 4/1974 | Izuta . | |
| 4,002,236 | 1/1977 | Tolleson | 206/315.11 |
| 4,043,020 | 8/1977 | Hoggard . | |
| 4,054,121 | 10/1977 | Hoyt, Jr. . | |
| 4,125,927 | 11/1978 | Geary . | |
| 4,135,486 | 1/1979 | Enomoto . | |
| 4,150,469 | 4/1979 | Hoggard . | |
| 4,169,454 | 10/1979 | Jones . | |
| 4,387,697 | 6/1983 | Duke . | |
| 4,387,805 | 6/1983 | Lanius | 273/422 |
| 4,478,204 | 10/1984 | Kocsan . | |
| 4,553,522 | 11/1985 | Topping . | |
| 4,584,983 | 4/1986 | Ament . | |
| 4,607,606 | 8/1986 | Schaar | 124/89 |
| 4,631,770 | 12/1986 | Goldberg | 81/490 |
| 4,633,846 | 1/1987 | Ipock . | |
| 4,640,258 | 2/1987 | Penney et al. . | |
| 4,643,159 | 2/1987 | Ryan . | |

*Primary Examiner*—Randolph A. Reese
*Assistant Examiner*—A. Anthony Knight
*Attorney, Agent, or Firm*—Breneman & Georges

[57] ABSTRACT

A bow stabilizer is provided for mounting to a bow and balancing and dampening the vibrations during shooting. The stabilizer assembly includes a shaft threaded to the bow handle and extending in the forward direction therefrom. A weight member is axially and radially mounted to the shaft by an offsetting bracket which is slidable and rotatable about the shaft to provide variable positioning of the weight about the shaft and to provide proper distancing from the bow handle. In the preferred embodiment the weight is a hollow tubular housing for storing tools, extra arrowheads and the like which are commonly carried into the field. Additional embodiments of the invention provide additional pivotal joints to adjust the shaft horizontally and vertically with respect to the bow and pivotally adjust the weight with respect to the shaft.

25 Claims, 5 Drawing Sheets

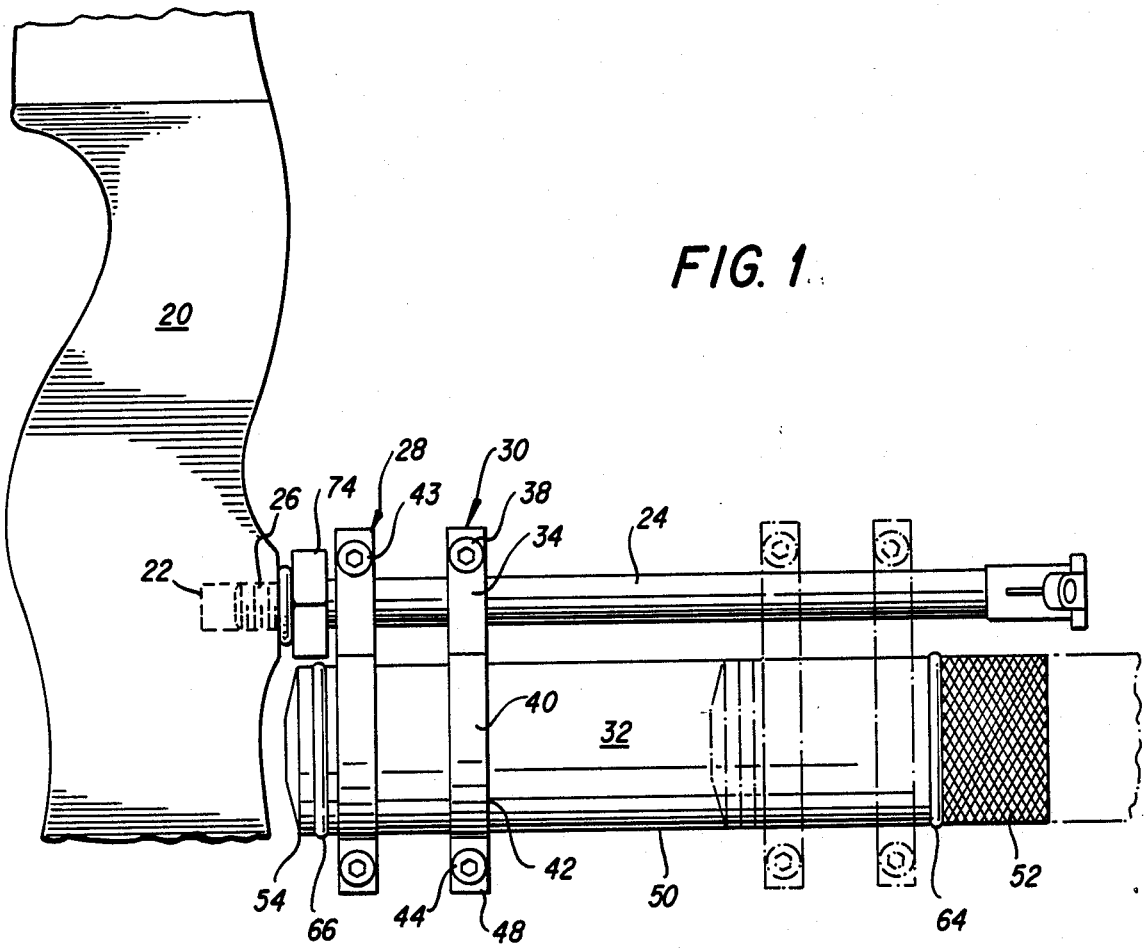
FIG. 1
FIG. 2
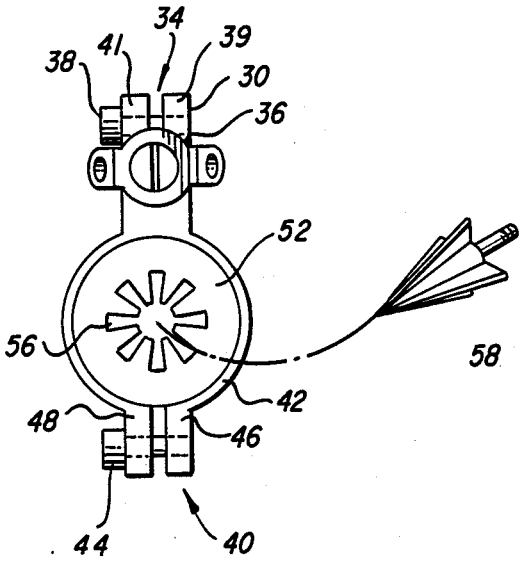
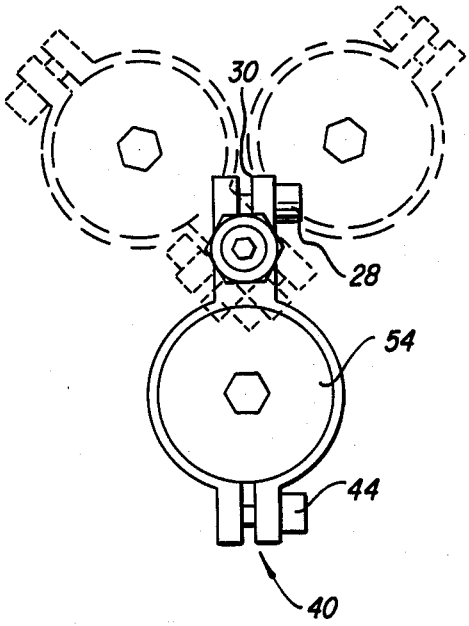
FIG. 3

ADJUSTABLE MULTI FUNCTION ROTARY BOW STABILIZER

BACKGROUND OF THE INVENTION

1. Field of the Invention

The invention is directed to an adjustable stabilizing weight assembly for mounting to a bow to balance and dampen vibrations which result when shooting a bow. More particularly, the invention relates to a bow stabilizer shaft attachment offset to the stabilizer shaft and capable of providing an infinite number of stabilization settings by the axial and radial positioning of the stabilizer on the bow stabilizer shaft while providing a number of different additional functions such as the storage of tools and the removal of arrowheads which become lodged in a tree or the like.

2. Description of the Prior Art

In recent years archery and bow hunting has seen a resurgence in popularity and with it the development of numerous improvements to the bow and associated tools and implements. The improvements to the archery bows have been principally through the design and development of the compound bow which employs a series of eccentrically mounted pulleys at the ends of the bow. The mechanical arrangement of cables and pulleys of the compound bow provides a release force on the arrow many times that of the drawing force. The major disadvantage of the compound bow is the increased weight and the poor balance from the cables and pulleys resulting in greater difficulty in maintaining stability of the bow. Compound bows also have required the archer to carry additional tools to sometimes adjust and fix the bow in the field.

Attempts have been made to compensate for the increased weight and poor balancing characteristics of the bow which generally comprise a counterbalancing weight mounted on the bow in a suitable location to equalize and properly balance the weight.

In addition to weight distribution, the compound bow suffers from vibrational movements during shooting which decrease the range and accuracy of the arrow. The vibrations to the bow occur in a number of directions resulting from the oscillations of the bow string the instant the arrow is released. In particular, the handle portion has a tendency to vibrate in the axial direction to the path of the arrow and in a circular manner about the handle. A stabilizer, which comprises essentially a weight at the end of an arm, when positioned on the bow tends to dampen some of these vibrations. Accordingly, the prior art has proposed several positioning arrangements to dampen the translational and rotational shock as well as balance the bow during shooting thereby attempting to increase the accuracy and convenience of shooting without unduly increasing the weight.

The prior art has achieved only limited success in effectively stabilizing the bow and dampening the vibrational movement. One form of the prior art generally employs a weighted member fixed to the end of a shaft as disclosed in Enomoto, U.S. Pat. No. 4,135,486 and Izuta, U.S. Pat. No. 3,804,072. These devices employ a plurality of fixed weights disposed at the end of an arm which extends in different directions and from different locations from the bow. This type of arrangement tends to be cumbersome to use and necessitates disassembly of the unit prior to storage.

Another example of a prior art bow stabilizer is disclosed in Sanders, U.S. Pat. No. 3,342,172. In this arrangement a weight member is pivotally mounted to a mounting plate secured to the front face of the handle portion of the bow. The pivotal mounting allows the archer to adjust the weight upward or downward with respect to the bow and to pivot the weight out of the way when not in use. This arrangement provides only a limited linear adjustment of the weight and limited weight distribution depending on the particular needs of the archer. The adjustment limitations tend to reduce the effectiveness of the stabilizer system and unnecessarily increase the weight of the bow.

Other forms of the prior art stabilizers include a pair of stabilizers consisting of a weight member positioned at the end of a shaft or leg which is pivotal from two points about a vertical axis and a horizontal axis from the bow. Examples of this type of device are disclosed in Hoyt, U.S. Pat. No. 4,054,121 and Topping, U.S. Pat. No. 4,553,522. This type of arrangement provides a universal angular adjustment which although more versatile than some of the prior art still has exhibited limited success. Stabilizers of this sort have the disadvantage of having a limited axial positioning capability of the weight. The weights are positioned a fixed distance from the bow and are only adjustable about an arcuate path. By having the weights fixed to the outer ends of the shafts, the stabilizer device is not readily retractable for easy maneuverability or enclosing within a storage case.

Morita, et al, U.S. Pat. No. 3,752,142 is representative of a stabilizer used to dampen the vibrations of the bow string by employing a pair of arms supporting a weight extending outwardly from the bow to form an essentially U-shaped pattern. The arms are pivotable about the vertical axis of the bow to adjust the weight up or down. This device also suffers from the disadvantage of not providing a full positioning range of the weight thereby limiting its effectiveness and requiring disassembly in order to conveniently store the bow.

Another form of the prior art stabilizing device is shown in Hoyt, U.S. Pat. No. 3,589,350 relating to a weight member telescopically adjustable on a support. The support extends directly forward from the handle position of the bow to distance the weight from the bow. The stabilizer being positioned in the forward direction is not able to dampen the vibrations which occur axially to the shaft.

A further form of a stabilizing device is shown in Masterfield, U.S. Pat. No. 4,570,608 which employs a fixed rod extending forwardly from the bow where the rod is filled with a viscous fluid. A removable weight is attached to the extreme end of the rod which may be replaced with a selection of different weights of different mass as desired by the archer. This arrangement also is of limited utility by having the weight in a fixed position on the bow and a fixed distance forward from the bow handle. As with most of the prior art devices, it is necessary to disassemble the unit before storage due to its length and fixed position.

During hunting the archer often has a need for various tools to adjust the bow, straighten arrows, remove an arrowhead from a tree and the like. As a result the archer is forced to carry a suitable pack containing these appertenances thereby increasing the burden of shooting and hunting in the field. Efforts have been made in the past to reduce this load and burden by developing multipurpose tools such that the number of tools carried is reduced.

One example of the prior art efforts to reduce the number of tools carried by an archer or hunter is disclosed in Duke, U.S. Pat. No. 4,387,697 and Ament, U.S. Pat. No. 4,584,983. In this arrangement a bow stabilizer is designed to alternatively serve as an arrowhead remover. In this type of device a removable balancing weight is secured to the end of a rod threaded to the bow handle. When the device is used as an arrowhead remover, the rod is removed from the bow and screwed onto the thread connection of the arrowhead. The weight is arranged to be slidable along the shaft to hammer against a stop or anvil on the shaft to apply a withdrawing force to the arrowhead. These prior art devices have been shown to have a limited effect on dampening the vibrations and proper balancing since the weight required to effectively remove the arrowhead exceeds that necessary to balance the bow. In addition, the fixed weights are not adjustable to a suitable stabilizing position.

A further example of this type of dual purpose tool is shown in Kocsan, U.S. Pat. No. 4,478,204 where the weight member of the stabilizer is provided with a set-screw to adjustably vary the position of the weight on a straight rod. When it is desirable to use the device to remove an arrowhead, the rod is removed from the bow and screwed onto the arrowhead. With the set-screw loosened the weight is slidable on the rod and can be used to hammer against an anvil portion to remove the arrowhead.

The general concept of utilizing a slide hammer type of tool to remove arrowheads which have been lodged in a tree are further exemplified in Hoggard, U.S. Pat. Nos. 4,150,469 and 4,043,020 and Geary, U.S. Pat. No. 4,125,927.

Other examples of the prior art have proposed a bow stabilizer employing a tool as the weight means thereby creating a dual-function device. For example, Penney, U.S. Pat. No. 4,640,258 employs a flashlight as the stabilizer weight while Ipock, U.S. Pat. 4,633,846 utilizes a knife or track line for the weight. Ryan, U.S. Pat. No. 4,643,159 discloses the general concept of mounting a camera on the bow handle which serves to help balance the bow.

The prior art devices have not provided an effective balancing and stabilizing system for a bow due to the excessive weight and the mounting arrangements which limit the positioning of the weights. In addition, these devices have not utilized to the fullest extent the possible alternative uses of the weight in order to reduce the number of tools to be carried by the archer and the weight associated therewith.

The present invention is directed primarily to a bow stabilizer providing for a unique weight distribution system not heretofore known. The novel stabilizer includes a shaft extending from the handle portion of the bow with a weight member offset from the shaft and infinitely radially and axially positionable to the shaft. The weight is slidable and pivotable about the shaft to provide a multitude of positions and a weight distribution depending on the needs of the archer.

The present invention further eliminates the need for the archer to carry a separate tool kit or pack by employing a tool container as the adjustable weight member. By utilizing a tool kit as the weight, an effective balancing means is obtained which is simple and inexpensive to manufacture The present stabilizing device provides an effective and compact means for balancing and dampening the shock otherwise occurring while avoiding he above-noted deficiencies of the prior art.

SUMMARY OF THE INVENTION

The disadvantages and limitations of the prior art apparatus for stabilizing bows are obviated while providing for the effective balancing and stabilization of a bow that is particularly suited for compound bows. The invention is of a rugged construction, compact and easily adapted to different types of bows for use under a variety of field conditions encountered in hunting or shooting conditions.

The present invention provides a unique arrangement of components to quickly and easily adjust a weight about a plurality of axes to selectively balance the bow depending on the users particular needs and the status of the bow. A variety of adjustments are attainable depending on whether the quiver is attached to the bow, number of arrows and attachments to the bow which adjustments can be changed in the field as use requirements dictate. The invention utilizes a shaft extending forwardly from the bow and removably attached to the handle portion. The weight member includes an offsetting bracket which can slide along the shaft and be selectively fixed radially and axially thereon by a suitable locking device. In addition the weight and bracket can pivot radially about the shaft to position the weight radially thereabout. By offsetting the weight the bow can be balanced in the field and in use to compensate for other attachments mounted on the bow such as, for example, a quiver or string tracking device.

In the preferred form of the invention, the weight member is a hollow container adapted to receive a set of tools which are commonly needed in the field. These tools may include allen wrenches and screwdrivers used to adjust and tighten the components on a compound bow, nocking pliers to set the nocking point, saw blades and the like. By incorporating the tools in the container of the weight member the extra packs or knapsacks often required by a hunter can be eliminated.

The novel bow stabilizer according to the present invention, further is adapted to serve as a multi-use tool where the shaft can be removed from the bow and screwed onto an arrowhead which has become lodged in a tree. By loosening the locking device, the weight can slide along the shaft and hammer against an anvil portion to withdraw the arrowhead without damaging the shaft of the arrow or the arrowhead.

The end of the shaft is also designed to act as a handle to receive a saw blade or other tool which is stored in the hollow stabilizing weight. Alternatively, a pair of angled rods can be attached to one end of the shaft to receive a piece of standard surgical tubing to form a slingshot for dispensing tracking scents or the like.

In use the bow stabilizer is adjusted in the field in accordance with the present invention by simply loosening the locking device whereby the weight member can slide along the shaft and rotate radially about the shaft to the desired position with respect to the bow. In the preferred embodiment a system for marking selected positions is used so that the stabilizer can also be returned to predetermined positions. When not in use, the weight can be retracted against the bow handle whereby the bow can be stored in a case without removing the stabilizer from the bow.

BRIEF DESCRIPTION OF THE DRAWINGS

Other advantages of the invention will become apparent to those skilled in the art from the following detailed description of the invention in conjunction with the accompanying drawings in which:

FIG. 1 is a side elevational view of the novel bow stabilizer attachment mounted to a bow partly in section illustrating the stabilizing weight in a retracted and an extended position in phanton in accordance with the invention;

FIG. 2 is a front view as seen from the right side of the bow stabilizer attachment of FIG. 1 illustrating the front end cap of the weight member in accordance with the invention;

FIG. 3 is a rear view as seen from the left side of FIG. 1 illustrating the radial adjustable feature of the invention;

DETAILED DESCRIPTION OF THE INVENTION

Figure 4:
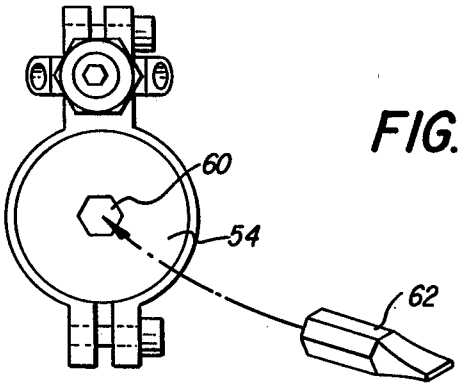
FIG. 4 is a rear view of the bow stabilizer attachment as seen from the left side of FIG. 1 illustrating the rear end cap of the weight member in accordance with the invention.

The invention is directed to a device primarily for balancing and stabilizing a bow and in particular a compound bow during shooting. In the preferred embodiment of the invention the stabilizer attachment is offset from the stabilizer shaft and is radially and axially adjustable to position the weight in a number of different arrangements to optimally distribute the weight to effectively balance the bow.

Referring now to FIG. 1, the bow stabilizer attachment in accordance with the invention when in use is mounted on a bow 20 by a threaded recess 22 generally provided during the manufacturing of a conventional bow. If the bow is not provided with such a suitable threaded insert in the manufacturing process the threads can be drilled and tapped as is generally added to the more sophisticated bows.

The bow stabilizer includes an elongated shaft 24 having a male threaded end 26 which is screwed into the recess 22 of the bow 20. In the preferred application of the invention a pair of identical offset bracket members 28 and 30 are employed to offset and adjustably mount the stabilizer weight 32 to the shaft 24. As can be recognized from FIG. 2, the bracket member 30 includes a first split ring 34 defining a first aperture 36 which receives the shaft 24. A screw element 38 is threaded to the legs 39, 41 of the split ring 34 to frictionally engage and clamp the bracket member 30 to the shaft in a fixed position. A similar screw 43 is threaded to the legs of bracket member 28 in a similar manner.

The bracket 30 may optionally include a second split ring 40 defining a second aperture 42 which holds the weight 32. A second screw member 44 extends through the legs 46 and 48 of the split ring 40 to clamp against and hold the weight 32 in a fixed position.

A bow stabilizer constructed in accordance with the invention allows the weight 32 to be axially and radially positioned in number of places on the shaft 24 to evenly distribute the weight and balance the bow depending on the particular needs of the archer as will be described hereafter in greater detail. As can be seen in FIG. 1, loosening the screws 38 and 43 of the brackets 28 and 30 the brackets 28 and 30, while holding the weight 32, is all that is required to slide the weight 32 along the shaft 24 to a desired position where the screws 38, 43 can again be tightened to radially and axially fix the brackets and the weight on the shaft 24. A further feature of the preferred embodiment as best shown in FIG. 3 allows the weight member 32 secured to the brackets 28 and 30 to pivot about the shaft 24 whereby the weight is radially positioned about the axis of the shaft 24.

In operation the weight member 32 is preferrably stored in the retracted position near the threaded end 26 of the shaft 24 as shown in FIG. 1. By loosening screws 38, 43 on the brackets 30 and 28 the weight 32 is positioned by sliding the brackets and rotating them about the shaft 24 as shown in phantom lines of FIG. 1 and FIG. 3. This radial and axial adjustment feature allows the archer to compensate for the poor weight distribution commonly found in bows and particularly compound bows. The pulleys employed in compound bows tend to make the rear side of the bow heavy so that a counter-weight must be positioned on the forward side to compensate for the additional weight. The stabilizing weight of the invention can be selectively positioned along the shaft 24 as desired to provide proper balance for a number of different sizes and makes of bows and personal preferences of the archer and to accommodate the addition of the quiver to the bow and changes in weight to the quiver as arrows are used in shooting.

The use of quivers by the archer also contribute to the weight and poor balance of the bow. Since arrow quivers are commonly mounted to the side of the bow a transverse as well as longitudinal imbalance of the bow results. To compensate for this poor weight distribution the weight member of the novel bow stabilizer can be rotated about the shaft 24 as shown in FIG. 3 and axially positioned on shaft 24 as shown in FIG. 1 to distribute the weight to the side of the bow to correct both causes of the poor balance.

In the preferred form of the invention the weight member 32 is a hollow tubular housing member 50 having threaded ends to receive a front end cap 52 and a rear end cap 54. The tube 50 is of a suitable diameter and length to store a plurality of tools as illustrated generally in FIG. 6. The tools may include nocking pliers, saw blades, allen wrenches, screwdriver tips and the like. In addition, the tube 50 provides a suitable storage container for extra arrowheads and tracking scents.

The bow stabilizer in the preferred form of the invention provides a number of other functions in addition to effectively balancing the bow. For example, as best shown in FIG. 2 the front end cap 52 includes a star shaped recess 56 of a dimension able to engage an arrowhead 58 to aid in unscrewing the arrowhead from the arrow shank (not shown). As can be seen in FIG. 4 the rear end cap 54 is provided with a hexagonal recess 60 to receive a conventional complementary screwdriver head 62 which may include a variety of tips which can include flat, phillips or other forms.

The front end cap 52 and the rear end cap 54 are screwed into threaded ends to close the ends of the tube 50. To maintain the tools and accoutrements stored within the tube 50 in a clean and dry condition a suitable sealing arrangement is included which may include conventional O-rings 64 and 66 disposed on the threaded portions 68 and 70 of the front and rear end caps respectively. A suitable resilient foam or plastic packing material can be employed at the front and rear portion of the tube 50 to hold the tools in place and prevent rattling. The resilient packing serves the additional advantage of absorbing and dampening some of the vibrations caused by the bow string during shooting.

While hunting in the field or target shooting it is not uncommon for an occassional arrow to stray off course and become embedded in a tree, fence post or the like. In such situations it is extremely difficult to remove the arrow from the tree without damaging the arrowhead or the arrow shank. Often times the archer must unscrew the arrow shank from the arrowhead and replace it with a new arrowhead while leaving the embedded arrowhead in the tree. The bow stabilizer in accordance with the invention provides a tool for effectively removing the arrowhead from the tree without damage to the arrow as hereafter described in detail.

Figure 5:
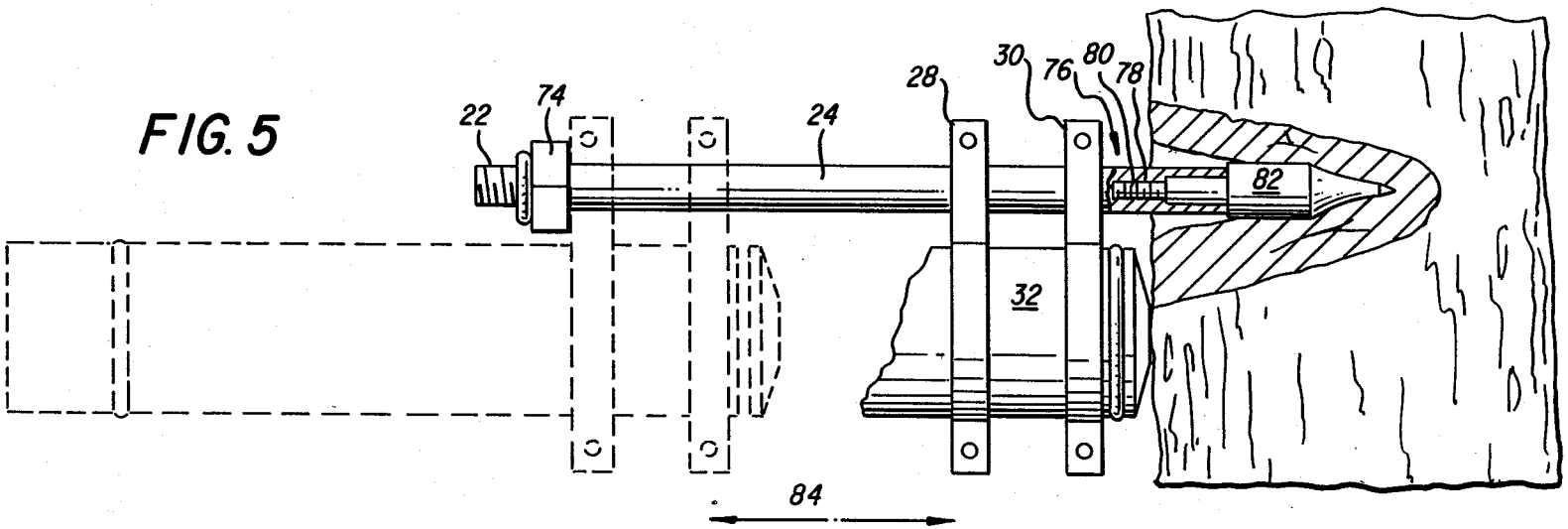
FIG. 5 is a side elevational view of the bow stabilizer attachment in use as an arrowhead extractor tool in accordance with the invention.

Referring to FIG. 5 the bow stabilizer is provided with a stop nut 74 threaded to the end of the shaft 24. The stop nut 74 serves as an anvil member during the arrowhead extraction process. The forward end 76 of the shaft 24 includes a threaded recess 78 able to screw onto the shank 80 of an arrowhead 82. When it is desirable to use the bow stabilizer as an arrowhead extractor the shaft 24 is unscrewed from the bow 20 and the forward end 76 of the shaft is screwed onto the arrowhead as shown in FIG. 5. With the screws 38 and 43 of the brackets 28 and 30 loosened the weight 32 and the brackets 28 and 30 can slide freely on the shaft. By striking the weight 32 and bracket 28 against the stop nut 74 a withdrawing force can be exerted in the direction of arrow 84 to remove the arrowhead 82. As can be seen in FIG. 5 by consecutively striking the weight 32 and bracket 28 against the stop nut 74 the arrowhead 82 can be removed from a tree without twisting, bending or otherwise damaging the arrowhead.

Figure 7:
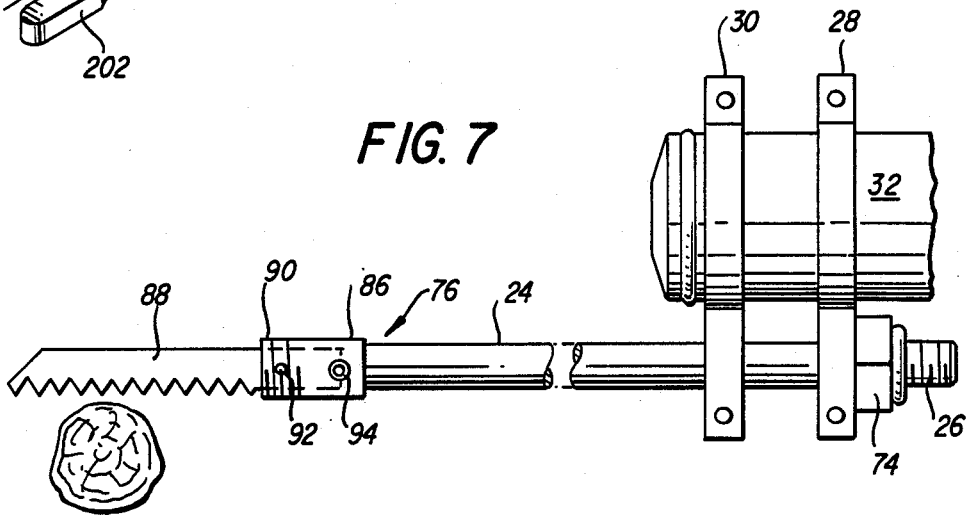
FIG. 7 is a side view of the bow stabilizer attachment functioning as a saw handle in accordance with the invention.

A further embodiment of the invention employs a tool tip 86 FIG. 7 which along with other tools and attachments can be stored within the tube 50 when not in use and which can be adapted to be screwed into the recess 78 in the forward end 76 of the shaft 24. As best shown in FIG. 7 the tool tip 86 is able to hold a number of tools including, for example, a saw blade 88 in a longitudinal slot 90. A pair of set screws 92 and 94 in the side of the tool tip 86 serve to clamp the saw blade 88 in place.

The saw blade 88 can likewise be stored in the housing 50 when not in use. When the saw is needed to cut small branches from the archer's view the bow stablizer is removed from the bow as previously described. An allen wrench which is stored in the housing is used to loosen the set screws 92 and 94 whereby the saw blade 88 can be inserted into the slot 90. With the set screws 92 and 94 tightened along with the tightening of screws 38 and 43, the bow stabilizer serves as a handle for the saw 88 during the cutting and sawing operations. The screws 43 and 38 of the brackets 28 and 30 supporting the weight 32 can also be loosened whereby the weight can slide away from the forward end 76 of the shaft 24 as shown in FIG. 7 to provide an easier gripping and a longer extension for the saw blade 88 to enable the user to reach distant branches.

Figure 6:
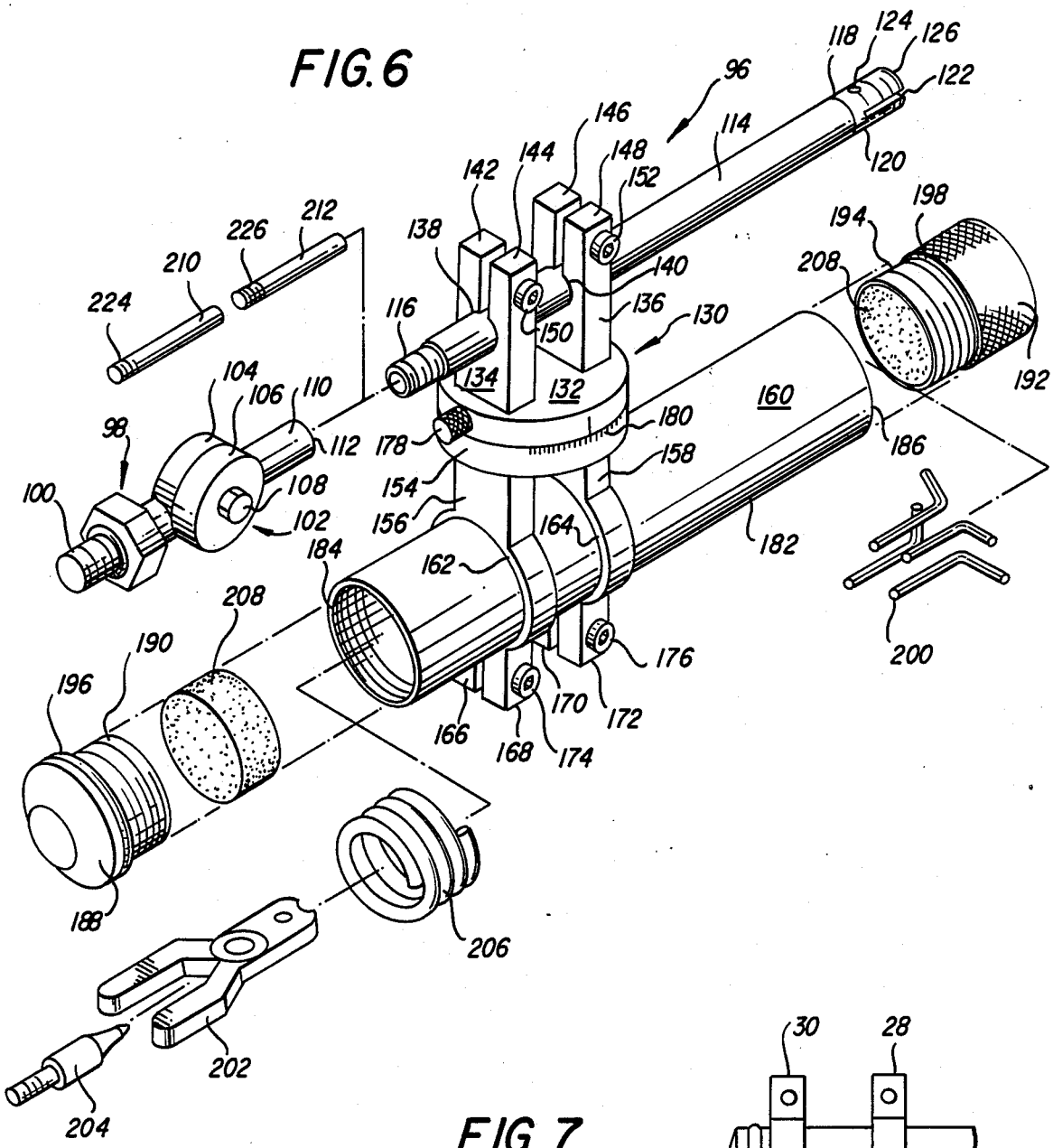
FIG. 6 is an exploded view of an alternative embodiment of the bow stabilizer attachment in accordance with the present invention.

A further embodiment of the invention is depicted in FIG. 6. The bow stabilizer shown generally as 96 includes a first bracket 98 having a threaded stud 100 to mount the bow stabilizer to the bow (not shown). A pivot assembly 102 on the bracket 98 includes a pair of friction plates 104 and 106. A threaded pivot pin 108 extends through the plate 106 into complementary threads in the plate 104 whereby the plates 104 and 106 can pivot with respect to one another. The friction between the plates 104 and 106 can be controlled by tightening the threaded pivot pin 108 to clamp the plates together to resist movement between the plates.

The pivot plate 106 further includes a stud 110 having an internally threaded recess 112. The stabilizer shaft 114 has a rear threaded end 116 and a forward end 118 having an internally threaded recess. As shown in FIG. 6 a tool tip 120 is threaded into the recess of the forward end 118. The tool tip 120 includes a slot 122 to receive a saw blade which is held in place by a set screw 124 as described above. External threads 126 are provided on the tool tip 120 to receive a Y-tip 128 as described hereafter in greater detail.

The stabilizer further includes a second pivot assembly suspended to the shaft 114 and shown generally as 130. The pivot assembly includes an upper pivot plate 132 having a pair of upstanding brackets 134 and 136. The brackets 134 and 136 are provided with a split ring arrangement to define apertures 138, 140 and legs 142, 144, 146 and 148. As can be seen in FIG. 6 the shaft 114 is received in the apertures 138, 140 of the brackets 134, 136 and clamped to the shaft 114 by tightening screws 150 and 152.

A lower pivot plate 154 cooperating with the upper pivot plate 132 includes a pair of downwardly extending brackets 156 and 158. The brackets 156, 158 hold the weight 160 by a similar split ring arrangement to define apertures 162, 164 and legs 166, 168, 170 and 172 to receive the weight 160. The weight 160 is secured to the brackets by tightening the screws 174, 176 which extend through the legs 168, 172 and are threaded into the legs 166, 170 as well known in the art. In the embodiment shown in FIG. 6 the screws 150, 152, 174 and 176 include a hexagonal shaped recess to receive a conventional allen wrench although thumb screws, slotted screws or screws having a knurled head may be employed.

The alternative embodiment shown in FIG. 6 provides for a universal weight distribution stabilizer by permitting adjustment of the weight about a vertical, horizontal and longitudinal axis to the bow. In operation, the stud 100 is screwed into the bow handle. The shaft 114 of the bow stabilizer 96 can then be pivoted about the pivot pin 108 upward or downward to the desired position. The locking screws 150 and 152 can then be loosened to slide the brackets 134, 136 supporting the weight 160 along shaft 114 as well as position the weight 160 radially about the shaft. When the brackets 134 and 136 are properly positioned with respect to the shaft 114 the set screws 150 and 152 are again tightened to maintain the proper positioning.

A further positioning adjustment can be made to the bow stabilizer 96 by loosening the set screw 178 on the upper pivot plate 132 and rotate the weight 160 and lower pivot plate 154 with respect to the shaft 114. In the preferred form of the invention a set of indicator markings 180 are provided on the adjacent faces of the upper pivot plate 132 and the lower pivot plate 154 to provide a scale for quick and accurate positioning.

If desired, the set screws 174, 176 of the lower brackets 156, 158 can be loosened whereby the weight can be adjusted on the brackets by sliding through the apertures 162 and 164 of the brackets.

In FIG. 6 an exploded view of the weight 160 is shown housing a collection of tools. The weight 160 comprises a cylindrical tubular housing 182 having internally threaded ends 184 and 186. A rear end cap 188 having a threaded portion 190 is screwed into the threads 184 of the rear end of the housing 182. A similar front cap 192 having a thread portion 194 screws into the threads 186 of the front end of the housing 182. To maintain the interior of the housing in a clean dry condition O-rings 196 and 198 are employed to seal the front and rear end caps.

The housing 182 in the preferred form of the invention is adapted to store a plurality of tools commonly employed by the archer or hunter in the field. Such tools may include, but are not limited to, a set of allen wrenches 200 to adjust the components on a compound bow and the screws on the bow stabilizer, nocking pliers 202, extra arrowheads 204 and elastic tubing 206 as will be described hereafter in greater detail. To prevent the tools from rattling and sliding within the housing 182 a suitable light weight resilient packing material 208 may be included to surround the tools.

Figure 8:
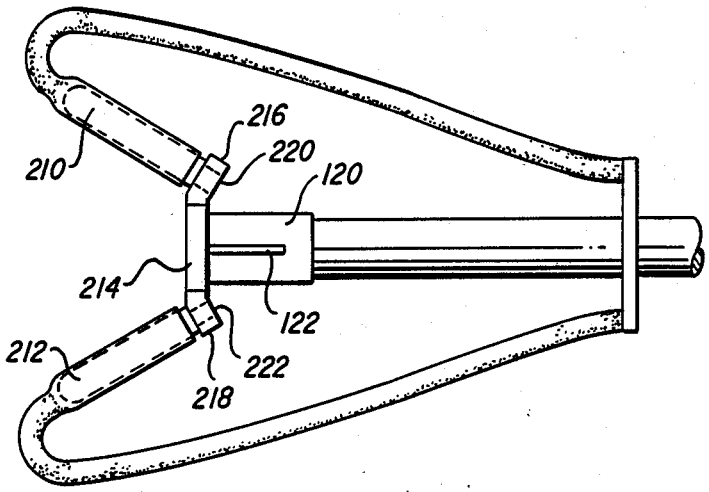
FIG. 8 is a side view of a sling shot attachment fixed at one end of the shaft of the bow stabilizer attachment in accordance with the invention.

A further embodiment of the invention as shown in FIG. 6 provides a pair of arms 210, 212 which can be stored in the hollow shaft 114. Referring to FIG. 8 a Y-nut 214, which is normally stored within the housing 182 is screwed onto the threads 126 of the tool tip 120. The Y-nut 214 includes a pair of legs 216, 218 having an internally threaded recess 220, 222 respectively. The arms 210 and 212 are provided with a threaded end 224, 226 whereby the arms 210 and 212 can be screwed into the Y-nut 214 as shown. When assembled, the ends of the elastic tubing 206 are able to slide over the arms 210 and 214 in the form of a sling shot. The sling shot can then be used to dispense scents, attractants or baits into areas which would be difficult for a hunter to otherwise reach.

Figure 9:
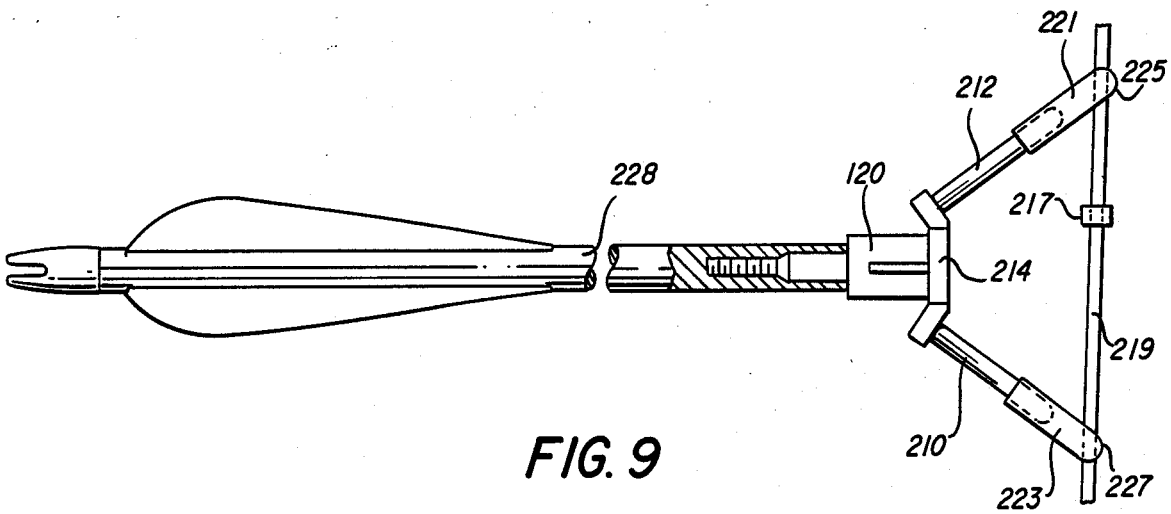
FIG. 9 is a side view of an alternative embodiment of the bow stabilizer attachment illustrating the tip employed to align a nocking point on the bow string in accordance with the invention.

In another application of the invention as shown in FIG. 9 a means for properly positioning a nocking point 216 on the bow string 218 is illustrated with respect to the bow handle and arrow rest (not shown). To achieve proper alignment of the nocking point 216, nocking square points 220 and 222 are placed on the arms 210 and 212. The nocking square points 220, 222 are provided with a notch 224 and 226 respectively to receive the bow string during positioning of the nocking point 216.

In operation the tool tip 120 having the Y-tip 214 and arms 210, 212 assembled thereon is screwed onto the shank of an arrow 228. The arrow is placed on the arrow rest of a bow with the nocking square points 220 and 222 placed against the bow string 218. As shown in FIG. 9 the nocking point 216 can be easily positioned on the string 218 by sighting the nocking point 216 along the properly positioned arrow.

Figure 10:
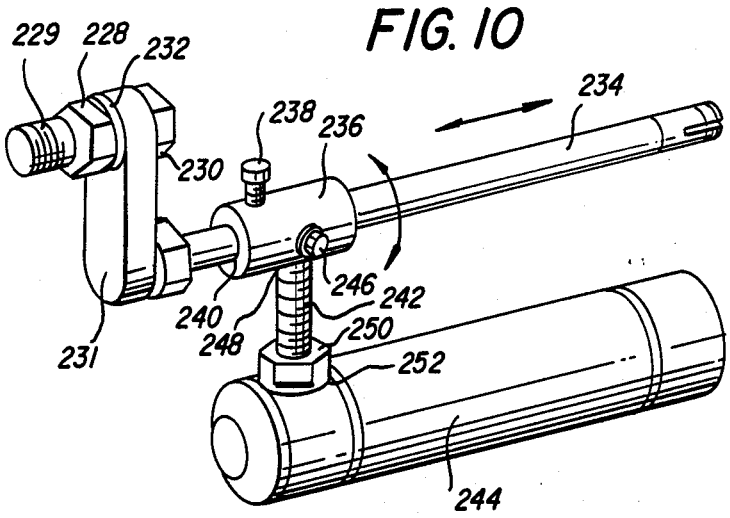
FIG. 10 is a perspective view of a further embodiment illustrating an alternative system for utilizing an adjustable weight in accordance with the invention.

Referring to FIG. 10 a further embodiment of the bow stabilizer is depicted having a number of pivotable mounts to selectively position the weight member. The stabilizer includes a threaded mounting stud 224 which screws into the bow handle. A first pivot arm 226 is provided at one end of the mounting stud 224 to be axially rotatable about the mounting stud 224. The pivotal movement of the pivot arm 226 is restrained by nuts 228 and 230 threaded onto the mounting stud 224 on either side of the pivot arm 226. A suitable bushing 232 may also be provided between the nuts 228 and 230 and the pivot arm 226 to frictionally engage the pivot arm to allow limited pivotable movement of the arm 226.

A longitudinal shaft 234 is attached to the opposite end of the pivot arm 226 such that the shaft 234 and the mounting stud 224 are essentially parallel and offset from each other. As can be seen in FIG. 10 the pivot arm 226 can be rotated about the mounting stud 224 such that the shaft 234 can be positioned radially about the mounting stud 224.

A slide bracket 236 having an axial bore 240 and thumb screw 238 is disposed on the shaft 234. The slide bracket 236 can be adjusted axially along the shaft by loosening the thumb screw 238 and sliding or rotating along the shaft 234 as desired. An adjustable arm 242 supporting a stabilizing weight 244 is connected to the slide bracket 236 in a second bore 248 disposed essentially perpendicular to the bore 240. The adjustable positioning of the arm 242 is controlled by tightening a thumb screw 246 extending through the slide bracket 236 to contact the arm 242 within the bore 248.

The stabilizing weight 244 includes a transverse aperture 252 to receive the arm 242. A pair of nuts 250 thread onto the arm on each side of the weight to fix the weight to the arm 242.

In the operation of the bow stabilizer as shown in FIG. 10 the mounting stud is screwed into the conventional mount on the bow handle. In the preferred form of the invention the tension between nuts 228 and 230 against the pivot arm 226 is sufficient to allow the arm to be rotated manually and thereafter be tight enough to remain in the selected position. By loosening the thumb screw 238 the weight 244 can be positioned radially as well as axially in relation to the shaft 234. If desired, the thumb screw 246 can be loosened and the weight 244 rotated about an axis perpendicular to the shaft 234. As with the other embodiments of the invention when the slide bracket 236 is adjusted on the shaft 234 to rest against the pivot arm 226 the stabilizer is in a retracted position capable of being stored in a case without removing the stabilizer from the bow.

Figure 11:
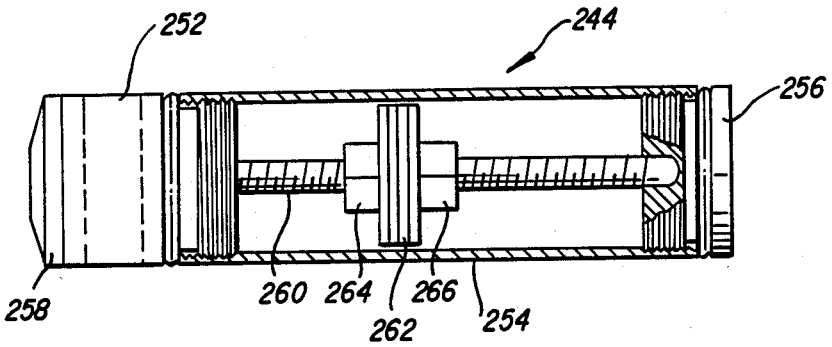
FIG. 11 is a cross sectional view of the weight member of the embodiment of FIG. 10.

Although the stabilizer weight may be a solid cylindrical member a further embodiment allows a weight disposed in cylinder 244 to be adjustable with respect to arm 242. As shown in FIG. 11 the weight 244 is a hollow cylindrical tube 254 having a front end cap 256 threaded into the front end of the tube 254. A rear end cap 258 having the transverse bore 252 for mounting on the arm 242 is threaded into the rear end of the tube 254. A threaded shaft 260 extends through the tube 254 and is journaled in the end caps 256 and 258. A plurality of disc-like weights 262 are positioned between a pair of nuts 264, 266 on the shaft 260. By loosening the nuts 264 and 266 the position of the weights 262 within the tube 254 can be adjusted to change the center of gravity of the weight 244 and to properly balance the bow. The number of weights 262 employed can of course, be increased or decreased as needed.

Figure 12:
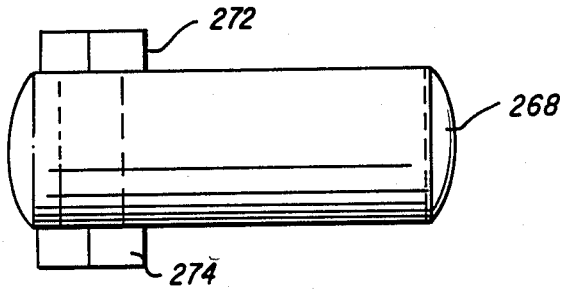
FIG. 12 is a side view of a further embodiment of the weight member in accordance with the invention.
Figure 13:
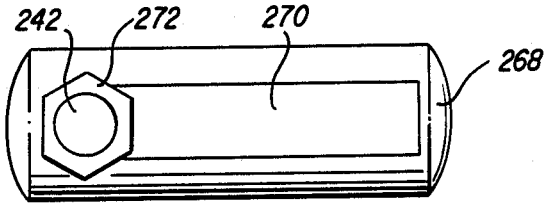
FIG. 13 is a top plan view of the weight member of FIG. 12.

A further embodiment of the invention employs a solid stabilizing weight 268 having a longitudinal slot 270 as shown in FIG. 12 and FIG. 13. This type of balancing weight like the balancing weight illustrated in FIG. 10 is generally advantageously employed in bows other than compound bows where tools are not required. When mounted, the threaded arm 242 passes through the slot 270 and is clamped thereto by tightening a pair of nuts 272 and 274 threaded onto the arm 242. By loosening one of the nuts 272 or 274 the weight 268 slides on the arm 242 to the desired position at which point the nut is again tightened to secure the weight in a fixed position.

The bow stabilizer constructed in accordance with the present invention provides a simple means to balance a bow during shooting while being relatively light weight and providing an effective balance for all types of bows. The stabilizing weight is fully adjustable with respect to the bow handle in the longitudinal and transverse directions.

The stabilizing weight being readily slidable on the shaft can be moved away from the bow handle to counterbalance the weight of the bow. When in the extended position the shaft and weight in addition to balancing the bow absorbs the transverse vibrations that pass through the bow during shooting. The offsetting bracket holding the weight radially outward from the shaft has the further advantage of being able to absorb the vibrations which occur axially to the stabilizer shaft.

The stabilizer weight housing in the preferred embodiment is a hollow tube for storing tools. The weight of the stabilizer can be varied as desired but should be in the range of about 8 to 16 ounces. To compensate for the changes in the weight due to different tools placed within the housing the position of the housing on the stabilizer shaft can be changed in relation to the different weights.

In the disclosed embodiments the weight member is generally a cylindrical tube ranging in size between 4 to 6 inches. The main shaft on which the brackets supporting the weight slides is between 5 and 7 inches. In the preferred embodiment the cylindrical tube is 4 inches and the main shaft is 5 inches. When in the fully extended position the cylindrical tube is spaced outwardly from the bow handle approximately 8 to 9 inches. The length of the cylindrical tube and the main shaft are not dependent on one another and can be sized according to the needs of the archer.

Other embodiments of the invention will be apparent to those skilled in the art in view of the specification and particular applications of the inventions. For example in particular applications the adjustment of the weight in or around the stabilizing shaft can be provided by preset positioning or end caps can be rotated to adjust the position of the weight in the container. Therefore it is intended the specification and examples should be considered as exemplary only, and the true scope of the invention should be included in the following claims which should be construed to cover the novel features and advantages of the invention.

What is claimed is:

1. A radially and axially positionable weight assembly to provide a bow stabilizer for a box comprising:

(a) a substantially cylindrical stabilizer shaft having a first end and a second end, said first end having means for removable attachment to a bow;

(b) an offsetting bracket means slidably mounted on said substantially cylindrical stabilizer shaft including locking means disposed on said bracket means for axially and radially locking and positioning said bracket means axially and radially along the length of said substantially cylindrical stabilizer shaft; and (c) a stabilizing weight assembly attached to said bracket means disposed in a plane substantially parallel to said stabilizer shaft and axially and radially positionable with respect to said stabilizer shaft.

2. The bow stabilizer of claim 1 wherein said locking means comprises a clamping means integral with said bracket to grip said shaft.

3. The bow stabilizer of claim 2 wherein said clamping means comprises a split ring assembly to define a first aperture adapted to receive said shaft.

4. The bow stabilizer of claim 3 wherein said bracket includes means defining a second aperture, wherein said stabilizer weight assembly is removably received in said second aperture.

5. The bow stabilizer of claim 4 wherein said means defining said second aperture is a split ring assembly surrounding said stabilizer weight assembly wherein said weight means is slidable within said second aperature.

6. The bow stabilizer of claim 1 wherein said stabilizer weight assembly is a substantially hollow cylindrical assembly having closed ends and a shaft disposed between said caps and a moveable weight disposed on said shaft.

7. The bow stabilizer of claim 1 wherein said stabilizer weight assembly is a substantially hollow cylindrical assembly having closed ends that provides a housing for tools.

8. The bow stabilizer of claim 7 wherein one of said closed ends includes a means to engage an arrowhead whereby said arrowhead can be unscrewed to remove said arrowhead from an arrow shaft.

9. The bow stabilizer of claim 8 wherein said other end of said closed ends includes means to receive a tool shank.

10. The bow stabilizer of claim 9 wherein said tool shank is the shank of a screwdriver tip.

11. The bow stabilizer of claim 1 further comprising an offsetting shaft disposed between said offsetting bracket means and said stabilizing weight assembly including means for rotating said stabilizing weight assembly in a plane parallel to said stabilizer shaft.

12. The bow stabilizer of claim 11 wherein said means for rotating said stabilizing weight assembly includes a pair of plates axially slideable and frictionally engageable.

13. The bow stabilizer of claim 12 wherein said plates include means for setting and recording their axial position.

14. The bow stabilizer of claim 11 wherein said means for rotating said stabilizing weight assembly includes means for increasing or decreasing the distance between said stabilizing weight assembly and said stabilizer shaft.

15. A combination variable position storage unit and stabilizer assembly for a bow comprising:

(a) a main stabilizer shaft having a first and second end, said first end having means for removable attachment to a bow;

(b) an offsetting bracket means rotatable and longitudinally slidable on said shaft; and (c) stabilizing weight means disposed on said bracket means whereby said weight means is disposed parallel to said shaft, said stabilizing weight means comprising means to receive and store a plurality of tools.

16. The bow stabilizer of claim 15 wherein said means to receive said tools is a hollow tubular member having removable front and rear end caps.

17. The bow stabilizer of claim 15 wherein said second end of said shaft includes means to hold at least one tool during use.

18. The bow stabilizer of claim 16 wherein said rear end cap includes means to hold a tool during use.

19. The bow stabilizer of claim 16 wherein said front end cap includes means to engage an arrowhead whereby said arrowhead can be unscrewed from an arrow.

20. A variable position bow stabilizer for attachment to a bow comprising:

(a) a first bracket having means to mount to the front of a bow and having an axis extending from the front of said bow;

(b) a first pivot member interconnected to said first bracket and pivotable about said axis of said first bracket;

(c) a main shaft interconnected to said first pivot member and disposed essentially parallel to the axis of said first bracket;

(d) a second bracket slidably and rotatably disposed on said main shaft and including first locking means to selectively fix said second bracket on said shaft, (e) a second shaft interconnected to said second bracket and disposed essentially perpendicular to said first shaft;

(f) an elongated stabilizing weight means having one end disposed on said second shaft and rotatably and axially adjustable on said second shaft; and (g) a second locking means to selectively fix said weight means on said second shaft.

21. The bow stabilizer of claim 20 wherein said weight means comprises a hollow tubular element, a threaded shaft supported axially in said tubular element and a weight element threaded to said threaded shaft and adjustable thereon.

22. The bow stabilizer of claim 20 wherein said weight means includes a transverse slot to receive said shaft.

23. A variable position weight and bow stabilizer for attachment to a bow comprising:

(a) a stabilizer shaft having a first end and a second end, said first end having means to mount to the front of a bow handle;

(b) a first bracket means rotatably and longitudinally slidable in relation to said stabilizer shaft;

(c) a second shaft disposed substantially perpendicular to said bracket means and said stabilizer shaft;

(d) a slidable and rotatable means disposed on said second shaft, said slidable and rotatable means providing a pivot about an axis essentially perpendicular to said stabilizer shaft; and (e) an elongated weight means attached to said slidable and rotatable means in a plane substantially perpendicular to said second shaft and in a plane substantially parallel to said stabilizer shaft.

24. The bow stabilizer of claim 23 further comprising a first locking means to lock said first bracket means in a fixed position.

25. The bow stabilizer of claim 23 further comprising a second locking means to lock said slidable and rotatable means with respect to said second shaft.

* * * * *